US012442114B2

(12) United States Patent
Micheli

(10) Patent No.: US 12,442,114 B2
(45) Date of Patent: Oct. 14, 2025

(54) CIRCULAR MACHINE FOR HOSIERY AND KNITWEAR AND PROCESS FOR CLOSING AN END OF A TUBULAR MANUFACTURED ARTICLE DIRECTLY ON A CIRCULAR MACHINE

(71) Applicant: SGM AUTOMAZIONI S.R.L., Brescia (IT)

(72) Inventor: Renato Micheli, Brescia (IT)

(73) Assignee: SGM Automazioni S.R.L., Brescia (IT)

( * ) Notice: Subject to any disclaimer, the term of this patent is extended or adjusted under 35 U.S.C. 154(b) by 0 days.

(21) Appl. No.: 18/834,804

(22) PCT Filed: Feb. 1, 2023

(86) PCT No.: PCT/IB2023/050882
§ 371 (c)(1),
(2) Date: Jul. 31, 2024

(87) PCT Pub. No.: WO2023/152605
PCT Pub. Date: Aug. 17, 2023

(65) Prior Publication Data

US 2025/0154697 A1 May 15, 2025

(30) Foreign Application Priority Data

Feb. 9, 2022 (IT) ..... 102022000002327

(51) Int. Cl.
*D04B 15/88* (2006.01)
*D04B 9/56* (2006.01)

(52) U.S. Cl.
CPC ..... *D04B 15/88* (2013.01); *D04B 9/56* (2013.01)

(58) Field of Classification Search
CPC . D04B 9/40; D04B 15/92; D04B 9/56; D04B 15/88; D04B 9/20
See application file for complete search history.

(56) References Cited

U.S. PATENT DOCUMENTS 4,407,145 A * 10/1983 Lonati ..... D04B 15/92 66/14
5,127,558 A * 7/1992 Paolo ..... D06G 3/04 223/42
6,158,252 A 12/2000 Conti
(Continued)

FOREIGN PATENT DOCUMENTS

WO 2007110894 A2 10/2007
WO 2021124067 A1 6/2021

*Primary Examiner* — Danny Worrell
(74) *Attorney, Agent, or Firm* — Volpe Koenig

(57) ABSTRACT

A circular machine for producing tubular manufactured articles and a respective process are provided. The circular machine comprises a turner arranged above and axially aligned with a cylinder of the machine and configured to extract the tubular manufactured article from said cylinder. At the same time, turn it inside out, and a transferring apparatus for collecting, from at least one first half of the cylinder needles, the respective stitches and coupling them with the stitches initially arranged on a second half of the cylinder needles. As such, there are two stitches that have to be joined by processing at least one yarn through at least said half of the cylinder needles on each of the needles of one half of the cylinder needles.

16 Claims, 9 Drawing Sheets

(56) References Cited

U.S. PATENT DOCUMENTS

| | | | | |
|---|---|---|---|---|
| 6,164,091 | A * | 12/2000 | Frullini | D04B 9/40 66/58 |
| 6,341,570 | B2 * | 1/2002 | Fujiwara | D05B 7/00 112/475.12 |
| 9,617,672 | B2 * | 4/2017 | Lonati | D05B 35/00 |
| 10,011,928 | B2 * | 7/2018 | Lonati | D04B 9/46 |
| 2010/0199723 | A1 * | 8/2010 | Conti | D04B 9/40 66/13 |
| 2010/0319410 | A1 | 12/2010 | Massimo | |

* cited by examiner

CIRCULAR MACHINE FOR HOSIERY AND KNITWEAR AND PROCESS FOR CLOSING AN END OF A TUBULAR MANUFACTURED ARTICLE DIRECTLY ON A CIRCULAR MACHINE

CROSS REFERENCE TO RELATED APPLICATIONS

This application claims the benefit of International Publication Number WO 2023/152605 filed on Feb. 1, 2023, which application claims the benefit of Italian Application No. IT 102022000002327 filed on Feb. 9, 2022, which are incorporated by reference as if fully set forth.

FIELD OF THE INVENTION

The present invention generally refers to the machines for producing knitted fabrics and, in particular, relates to a device for these machines and a process for closing one end of a tubular manufactured article, directly on a circular machine for hosiery or knitwear.

BACKGROUND OF THE INVENTION

Hosiery and knitwear circular machines basically comprise a rotating cylinder having at its periphery a plurality of parallel grooves which house the same amount of vertically arranged, i.e. vertically oriented, needles parallel to the generatrix of the cylinder. Alternatively, in so-called double-cylinder machines, two rotating cylinders are provided, a lower one and an upper one, both having peripheral grooves and mounted one above the other so that the respective grooves are aligned with each other. Thus, the needles can be slid into one or the other rotating cylinder, as needed. Each cylinder is rotated and at least one yarn to be knitted is fed to the needles via one or more feeding stations, also named feeders, combined with the cylinder(s).

The needles comprise a so-called hook portion and a latch adapted to close the hook portion in the stitch formation step, and are movable between a raised position, an intermediate or restrained position and a lowered position, in response to stresses imparted by cams which are combined with the outer surface of the rotating cylinder so as to be moved close to or away from it, in order to intercept at least one yarn and form the stitches.

Therefore, these machines produce tubular manufactured products whose ends are both open. Specifically, each rotating cylinder may rotate in continuous motion and in reciprocating motion, if portions shaped like a bag have to be produced, such as for example in the case of a sock, the portions intended to be fitted on the heel and on the tip of a user's foot. Usually, a sock is produced starting from its edge and ending with the toe portion.

In recent years, devices have been developed that allow to join the edges of one end of the manufactured article and, specifically, the end corresponding to the sock toe, at the beginning or at the end of its production, so as to achieve a nearly complete manufactured article, with the exception of possible accessory elements to be applied after its production, to proceed to possible subsequent dyeing and/or finishing and/or pressing steps.

In particular, hosiery machines have been proposed which are structured so that they can join the end edges of the sock by using the cylinder needles of the same machine.

Specifically, the document WO2007/110894A2 concerns a machine for closing a tubular article from the inside, such as a sock, by which the article is produced starting from the edge but keeping it sucked upwards during its production. The manufactured article is sucked from the beginning of its production within a recess formed at the level of a normally non-hollow shaft of a machine member. This recess has very small dimensions, since such shaft cannot have a large diameter due to structural issues of the same machine. Disadvantageously, therefore, the sock is not produced in a traditional manner but is kept on the reverse side during its formation, an extremely complex operation, is kept sucked in a recess of small dimensions, resulting in malfunctions, and involves substantial modifications to the same machine and to the normal production method of the sock.

A machine and a method in accordance with the document US2010/319410A1, which relates to a device for closing the end of tubular hosiery articles, have also been proposed. For transferring stitches from a first arc of needles to a second arc of opposite needles, the device comprises a semicircular sector which can be overturned and has elements ending in a bifurcation, each of them having a projection adapted to engage an end stitch formed by a corresponding needle and to transfer it to a corresponding needle of the second needle arc. Disadvantageously, such a solution provides for joining the two ends of the tip of the tubular article, with the same article being kept in its final configuration and, therefore, not turned inside out. Consequently, the seam of the tubular manufactured article is external to the same manufactured article, with a result that is unpleasant and often not accepted by consumers, which are accustomed to a seam which remains hidden in the inner side of the sock.

In order to overcome these drawbacks, the Applicant's international patent application WO 2021/124067 relates to a method and a circular machine which provide for a step of overturning the tubular manufactured article before its closing. In accordance with the proposed solution, the machine is combined with a device for turning inside out the tubular manufactured article, which is kept shifted sideways with respect to the cylinder of the machine during the formation of the tubular manufactured article, and which is brought thereat only during the turning step.

Such a solution has been provided in that the space above the machine cylinder, during the production of the tubular manufactured article, is occupied by the machine head and by the yarn feeding stations, but it has proved to be constructively complicated, since the lateral movement of this device and its centring with respect to the cylinder of the machine are difficult and expensive to be implemented. In particular, in the case of long socks, this device is considerably extended in height and therefore its handling and centring are even more complicated.

SUMMARY OF THE INVENTION

Object of the present invention is to solve the problems stated above with reference to the known art, by proposing a circular machine and a process for closing, from the inside, one end of a tubular manufactured article produced in a traditional manner, by means of a circular machine for hosiery or knitwear, which is provided with at least one lower cylinder, starting from one of its edges intended to remain open.

Another object is to propose a circular machine and a process which allow to close the end of a tubular manufactured article, while keeping the tubular manufactured article normally arranged in the lower cylinder during its production.

A further object is to propose a system which is simpler and more economical than the systems of the known art, which involves few modifications to the machine and is more efficient and less subject to breakages and wear and tear.

Still another object is to propose a closure of the end of the manufactured article which is robust and not prone to wear and tear and, at the same time, is aesthetically pleasant and made inside the tubular manufactured article.

These objects are achieved with a circular machine improved according to claim 1. Specifically, the machine comprises a turner combined with the same machine so as to be always axially aligned with the at least one cylinder and configured to extract the tubular manufactured article from the cylinder and, at the same time, turn it inside out, by bringing it and keeping it above the cylinder, and a transferring apparatus provided at least with means for collecting the stitches from a first half of the lower cylinder needles of the machine and, with the tubular manufactured article turned inside out, positioning them on the other half of the cylinder needles, together with the stitches originally present on such half of the needles.

Advantageously, the turner can be translated between a raised position, in which it is moved away from the cylinder and above the head of the machine, and a lowered position, in which it moves closer to the cylinder of the machine.

Such an arrangement allows not to carry out any lateral movement of the turner but possibly only vertical movements, from the top downwards and vice versa, to have the turner always correctly centred with respect to the cylinder and to be able to keep it aligned with the cylinder even during the production of the tubular manufactured article, by being arranged in a raised position with respect to the head of the machine.

Thanks to the turner, the inner surface of the tubular manufactured article is located on the outside, so that the seam of the tubular manufactured article and, in particular, the segment of free yarn, which is formed at the end of the joining of its end, remain inside the same tubular manufactured article, once it has been turned inside out again for its use.

Advantageously, during its production, the manufactured article is kept, as usual, inside the lower cylinder so that it is in its final configuration and not on the reverse side. The tubular manufactured article is turned inside out only after it has been completed, before closing one of its ends.

Preferably, after positioning the pairs of stitches on half of the cylinder needles, the turner repositions the tubular manufactured article inside the cylinder.

Advantageously, the turner is intended to join the transferring apparatus, in particular, with a sleeve combined with the transferring apparatus. For this purpose, the turner is preferably combined with the circular machine by means of a frame, on which it is movably mounted between a raised position, in which it is above the head of the machine, and a lowered position, in which it moves closer to the cylinder, and vice versa.

The turner comprises a containing body, or outer tube, inside which a tubular element is slidably mounted.

Preferably, suction means are combined with the containing body and/or the tubular element to assist the steps of extracting the tubular manufactured article from the cylinder and turning it inside out, and to keep the tubular manufactured article in the containing body during the step necessary to couple the opposite stitches of the last course to each other.

In a particularly preferred solution, at a lower end of the tubular element, at least two harpoons emerging from opposite sides are combined and configured so that they can be normally kept inside the tubular element and they can emerge therefrom during the step of turning the tubular manufactured article inside out.

Advantageously, a tube normally combined with the cylinder for housing the tubular manufactured article during its formation, is movable upwards to push the stitches of the last course below the latches of the respective needles. To facilitate this operation, the tube may have an outwardly flared end portion.

The transferring apparatus may be movable between a position, in which it is shifted sideways with respect to the cylinder of the machine, and a position in which it is at the cylinder of the machine and vertically aligned therewith. In order to allow the use of the turner and the positioning of the transferring apparatus at the machine cylinder, the head and the yarn feeding stations are combined with the circular machine so as to be able to be moved between a first position, in which they are at the cylinder, and a second position in which they are away from the cylinder, to make room for the positioning device.

Preferably, the head, with the yarn feeding stations, is combined with a supporting element which is susceptible of rotations sideways or upwards so as to move the head upwards or sideways along an arc of a circle corresponding to an angle between 45° and 90°, preferably between 60° and 90°.

Preferably, the head and yarn feed stations are movable sideways and are combined with the transferring apparatus by mechanical idler means which ensure a synchronous movement and correct centring of the transferring apparatus with respect to the cylinder. Thanks to this mechanical idler, in fact, the head, which is initially aligned vertically with the cylinder and centred with respect thereto, when it is moved sideways, it drags the positioning device with it so that it is in turn aligned vertically with the cylinder and centred with respect thereto. Preferably, the mechanical idler means are pivoted to head supporting means and to means supporting the transferring apparatus.

In a preferred solution, the transferring apparatus is structured to collect the respective stitch of the last course from each needle, to couple the stitches two by two and position each pair of stitches on one half of the cylinder needles. Specifically, the transferring apparatus may comprise a supporting element provided with a fixed portion and a movable portion, each carrying a plurality of transferring members equal in number to half the cylinder needles, in which the movable portion is initially aligned and coplanar with the fixed portion and can be rotated by 180° with respect to this position to bring each of its transferring members close to or in contact with a respective transferring member of the fixed portion. The transferring members may be arranged in the same direction as the needles, or perpendicular thereto.

Advantageously, the stitches can be collected from the cylinder needles through auxiliary collecting members and then transferred therefrom to the transferring members, possibly also by means of an upward movement of the flared end of the tube combined with the cylinder, so as to facilitate such a transfer.

The invention also relates to a process according to claim 7 for closing one end of the tubular manufactured article directly with part of the cylinder needles which have contributed to the formation of the same manufactured article. The process provides for turning the tubular manufactured article inside out and extracting the tubular manufactured article from the cylinder by means of a turner combined with the machine so as to be always axially aligned with the main cylinder of the machine; collecting the respective stitch of the last course from one half of the adjacent cylinder needles; arranging the stitches collected on corresponding needles of a second half of adjacent cylinder needles; positioning the tubular manufactured article again inside the cylinder; processing at least one yarn with said half of the cylinder needles to close the end of the tubular manufactured article. During the positioning of the pairs of stitches on one half of the cylinder needles, the needles of said half of the needles can be kept in a raised or unloaded position, or in the intermediate or retained position, depending on the type of processing.

The turning of the manufactured article inside out may take place after the collection of at least one half of the stitches of the last course.

The process provides for using a turner comprising a tubular element having at least two harpoons arranged on opposite sides of a lower end thereof, and provides for inserting the tubular element inside the tubular manufactured article until a lower end thereof comes out of the tubular manufactured article, holding the free end of the tubular manufactured article by means of harpoons and moving the tubular element upwards to drag the tubular manufactured article with it and turn it inside out.

Preferably, the harpoons can be movable between a retracted position, in which they are inserted in the tubular element, and an extracted position, in which they emerge therefrom, in such a way that during the insertion of the tubular element into the tubular manufactured article, they can remain inside the same tubular element and that, subsequently, they can be extracted to keep the free end of the tubular manufactured article firmly positioned on the tubular element.

In a particularly preferred solution, the process provides for pushing each stitch of the last course below the latch of the respective needle, by moving upwards a tube positioned in the cylinder, wherein said tube may comprise a flared end portion to facilitate the stitches to be shifted.

Advantageously, to carry out the closing of the end of the tubular manufactured article, the cylinder is rotated in reciprocating motion for at least three, preferably at least five and in particular seven semi-rotations, in which the needles are brought to a raised position in which they intercept the yarn to be processed and bring the stitches supported by them to an unloaded position, which allows them to be unloaded from the respective needle. These semi-rotations form a plurality of partial courses which serve to join the stitches of each pair of stitches together, so as to join the two opposite halves of the last course of the tubular manufactured article together.

In order to achieve a particularly robust closure of the end of the manufactured article, at least during the first semi-rotation, the yarn is fed to the needles by means of a yarn finger arranged so as to feed the yarn to the needles at a height lower than the height that the needles must reach in order to be able to catch the yarn fed by the other yarn fingers. This allows the pairs of stitches to be joined firmly and more effectively with the adjacent pairs.

Advantageously, at least one additional yarn is fed to the needles by means of at least one respective auxiliary yarn finger arranged in a position prior to the yarn feeding station comprising the yarn finger of the bottom yarn, with reference to the rotation direction of the cylinder. In particular, since the semi-rotations take place with reciprocating motion, two auxiliary yarns can be fed by means of two auxiliary yarn fingers arranged on opposite sides with respect to the yarn feeding station comprising the yarn finger of the bottom yarn and each activated according to the rotation direction of the cylinder. Advantageously, the two yarns hold each other, so as to achieve a further improved and even more robust seam.

Preferably, the at least one auxiliary yarn finger can be a yarn finger normally used to feed the so-called colour yarn.

As an alternative or in addition to the at least one additional yarn, a further yarn can be fed to the machine needles, in particular an elastic yarn fed by means of a so-called elastic yarn finger belonging to the so-called assembly selecting the elastic yarn. Such a solution allows to add a second knitted reinforcing yarn to the main yarn, thus making the seam extremely robust and particularly suitable for sports or work socks, which are subjected to high stresses during use.

Preferably, during at least the first semi-rotation, at least two, preferably at least four further needles, are brought to the raised position and are adjacent to a first and/or a last needle of the half of the needles carrying the pairs of stitches of the last course, in addition to the half of the needles carrying the pairs of stitches of the last course.

In order to ensure an even greater sealing, the closing of the tubular manufactured article can be carried out by alternating semi-rotations in which tightly-knitted stitches are made and semi-rotations in which loosely-knitted stitches are made.

In order to be able to carry out the steps of turning, collecting, coupling the stitches and their arrangement on half of the cylinder needles, the method provides for moving the head and the feeding stations away from the cylinder; arranging the transferring apparatus at the cylinder; and joining a lower end portion of the containing body with a sleeve combined with the transferring apparatus, to define a sealing connection. For this purpose, the turner can be brought to a lowered position in which it is at the transferring apparatus, with its end portion inserted into the sleeve.

Advantageously, the method provides for collecting individually, from each needle, the respective stitch of the last course of the manufactured article; coupling said stitches two by two and positioning each pair of stitches on one half of the cylinder needles.

To perform these operations, the stitches of the last course are collected by means of a transferring apparatus having a plurality of transferring members, each adapted to collect the respective stitch from a respective needle and structured to move opposite stitches closer together, and to position each pair of opposite stitches on a respective needle of one half of adjacent cylinder needles.

BRIEF DESCRIPTION OF THE DRAWINGS

However, the invention will be better illustrated in the following description with reference to the attached indicative and non-limiting drawings, in which.

DETAILED DESCRIPTION

In these drawings, a circular machine for hosiery or knitwear is generically referred to as 1. The machine can be of the type adapted to the production of socks or tights. The figures depict, by way of example, a machine of the single-cylinder type, also known as a mono-cylinder machine, but the machine could also be of the double-cylinder type.

Figure 13:
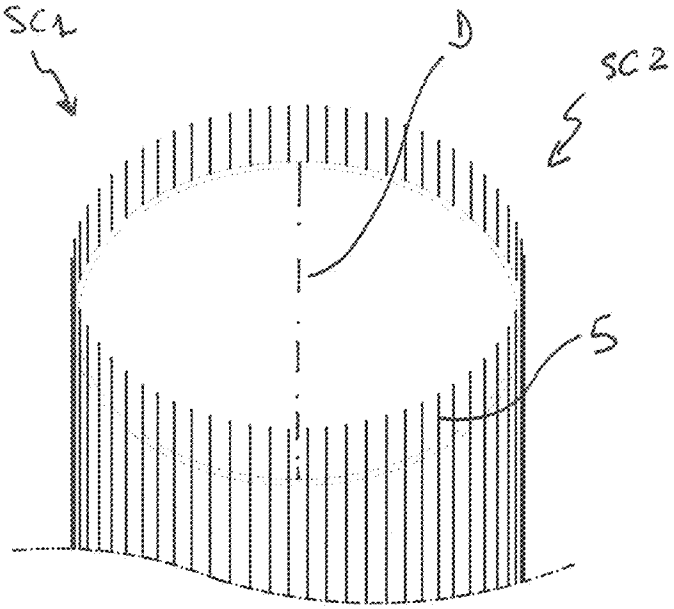
FIG. 13 shows a schematic view of the cylinder complete with needles.

This circular machine 1 comprises a base 2, a head 3, at least one main or lower cylinder 4, which is combined with the base and susceptible of at least partial rotations referred to as travels, in which a plurality of vertically arranged needles 5 are slidably mounted and arranged side by side so as to form a circle comprising a first semicircle SC1 and a second semicircle SC2, which have the same number of needles, as shown in FIG. 13. The machine can also comprise an upper cylinder—not shown—combined with the head and mounted above the cylinder 4 and aligned therewith, so that the needles 5 can slide in one or the other of such cylinders so that they can make plain or purl stitches. Each cylinder can be activated to rotate with continuous or reciprocating motion, depending on the production steps.

For the sake of simplicity, the following description will refer to a mono-cylinder machine, therefore a machine provided with only one cylinder, without thereby excluding that what is described below can also be applied to a machine of the double-cylinder type, therefore provided also with an upper cylinder.

At least one yarn feeding station 6 is combined with the head, to feed the needles with at least one yarn 7 to be processed, also referred to as bottom yarn, for the production of a tubular manufactured article 8 consisting of a sequence of stitches of at least said yarn, which form a plurality of consecutive courses. The wording "course" refers to stitches made in one travel, i.e. in a total or partial turn of the cylinder. Normally, at least one second yarn, referred to as main yarn, and possible yarns of other types, such as so-called colour yarns, are fed to the machine needles to produce patterns, drawings or writings and elastic yarns or of various types.

Figure 14:
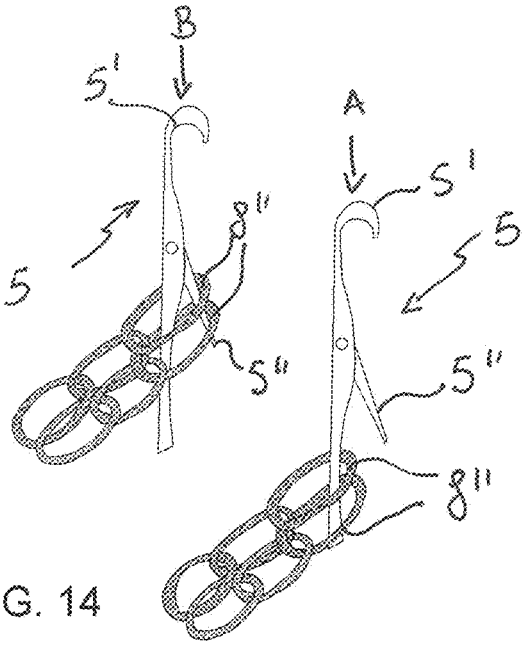
FIG. 14 shows two machine needles in two different positions.
Figure 15:
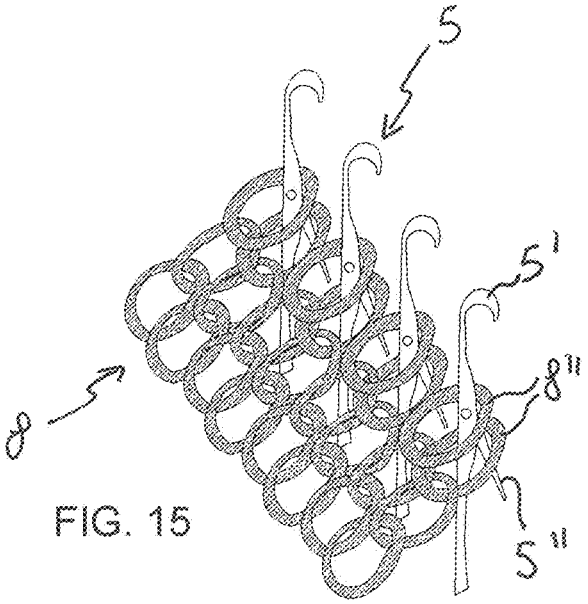
FIG. 15 shows some machine needles each carrying a pair of stitches.
Figure 18:
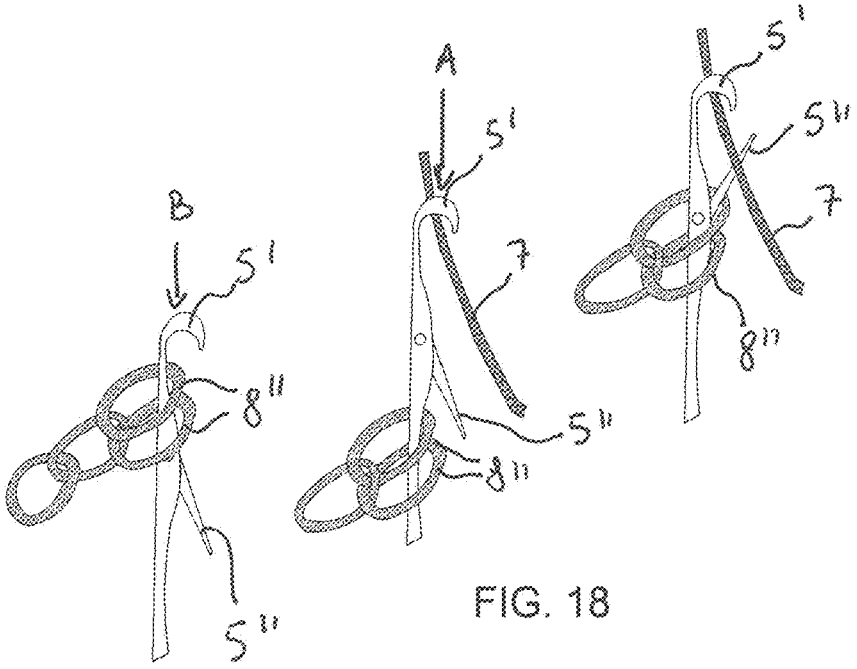
FIG. 18 shows a machine needle in three different conditions during a first step of closing the end of the manufactured article.

For the production of the stitches, usually the needles can comprise a portion referred to as hook 5' for catching and holding the yarn to be processed and a latch 5" for closing the hook during the formation of the stitch. Each needle can be selectively brought to:

- a lowered position, in which the hook does not intercept the yarn but unloads the stitch made in the previous travel,
- a raised A or unloaded position, in which the hook intercepts the yarn and brings the stitch made in the previous travel below the latch, as shown in FIG. 14, to be able to unload it when the needle is brought to the lowered position, or
- an intermediate position, defined as a retained position B, in which the hook holds the stitch made in the previous travel above the latch, as shown in FIG. 14, and intercepts the yarn.

Specifically, the tubular manufactured article may be a sock and is made starting from an edge portion thereof, followed by a leg portion, if any, to be worn on at least part of a user's leg, then by a foot portion, and ending with a toe portion to be worn on the user's toes. At the end of the production of the manufactured article, the stitches 8" which form the last course 8' of the manufactured article, i.e. the round of knitting which constitutes the terminal end of the manufactured article, are on the cylinder needles.

The tubular manufactured article remains in the cylinder 4 of the machine during its formation and is kept sucked downwards by means of suction means normally provided on the machines of the type object of the present invention. This allows not to make any modifications to the machine, except those strictly necessary for closing the end of the tubular manufactured article and, in particular, for closing the toe of a sock.

According to the invention, the machine comprises a turner 9 configured to operate directly above the cylinder 4 of the machine and to be always arranged in axis with the at least one cylinder. The turner is structured to overturn the tubular manufactured article once it has been formed, so as to turn it inside out. Preferably, the turner comprises a frame 10 for its fixing to the base of the circular machine and can be movable from the top downwards, and vice versa, to be moved closer to or away from the cylinder. For this purpose, the turner can be constrained to the supporting frame by supporting means 11 which can slide with respect to the frame, such as slides. Advantageously, the supporting means can be motorised in order to be able to perform their descending and ascending travels automatically.

The machine can also be combined with a transferring apparatus 12 adapted to collect, from at least one half of consecutive needles of the cylinder needles 5, i.e. from at least one first semicircle SC1, the respective stitches of at least one first half of the last course 8', and to position the collected stitches on the other half of the cylinder needles, i.e. on the other semicircle SC2, or vice versa, so that each of these needles supports a pair of stitches instead of a single stitch, one of which belonging to the first half of the last course and the other to the second half of the last course.

Figure 1B:
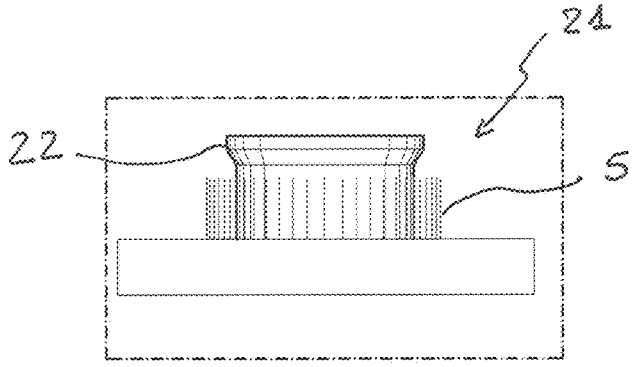
FIG. 1*b* shows a detail of FIG. 1, with the machine in a different condition of use.
Figure 1:
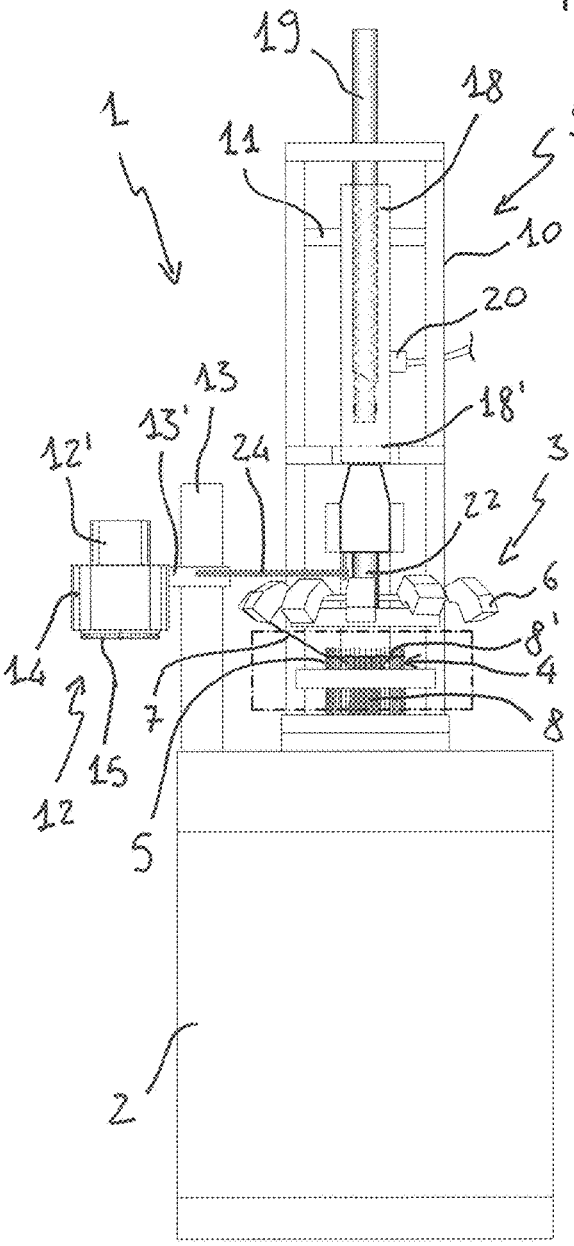
FIG. 1 shows a front view of a circular hosiery or knitwear machine provided with a turner and a transferring apparatus according to the present invention, in a normal condition of use, at the end of the production of a tubular manufactured article.
Figure 12:
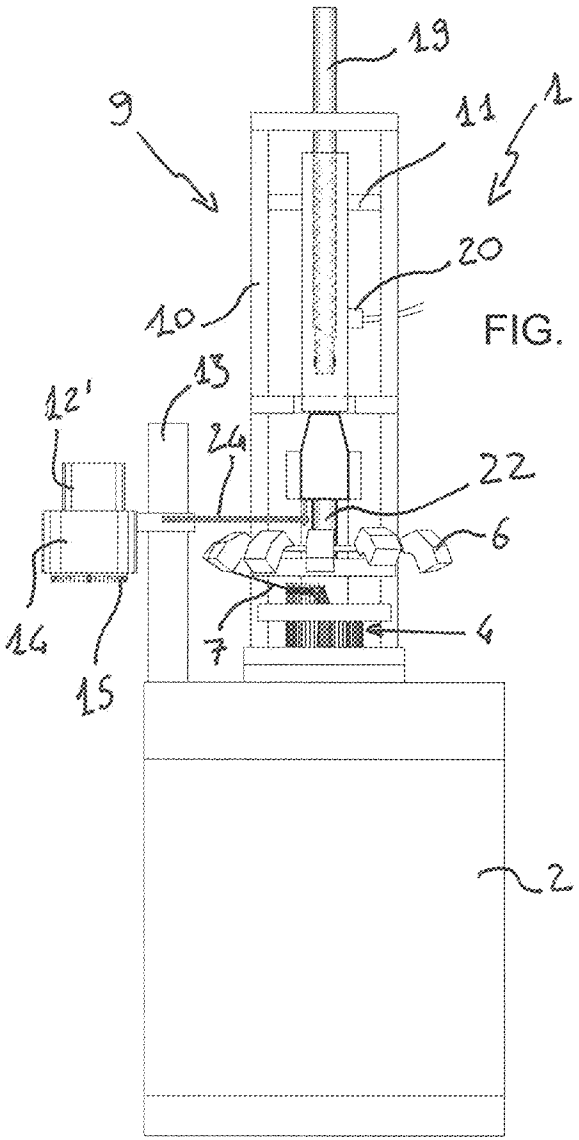
FIG. 12 shows a view of the machine similar to that of FIG. 1 but with the last stitches of the tubular manufactured article arranged on one half of the cylinder needles.

Preferably, the transferring apparatus is combined with the base by means of a support 13 having an arm 13' rotatable around the same support, to move the transferring apparatus between a resting position as shown in FIGS. 1 and 12, in which it is shifted sideways with respect to the at least one cylinder of the machine, and a working position shown in FIGS. 2-11, in which it is located at the cylinder of the machine and aligned therewith.

Through the transferring apparatus, the stitches initially arranged on the needles belonging to the first semicircle SC1 and forming the first half of the last course, are arranged on the needles belonging to the second semicircle SC2, together with the stitches originally supported by the needles of such second semicircle and constituting the second half of the last course, so that two stitches 8", which were initially in positions opposite each other with reference to a diameter D which divides the two semicircles, are on the same needle belonging to the second semicircle, as shown in FIGS. 14, 15, 17 and 18. The wording "needles in positions opposite each other with respect to a diameter of the cylinder" refers to needles that are axially symmetrical with respect to said diameter. This operation is often referred to as "overturning of the stitches" and allows the first and second halves of the last course to be brought closer to each other, i.e. the two knit semicircles that constitute one end of the tubular manufactured article.

Once the stitches have been collected from the first half of the cylinder needles, these needles can be brought to the lowered position so as not to interfere with the subsequent processing steps.

Preferably, the transferring apparatus is designed to collect the respective stitches of the last course 8' from all the cylinder needles, to couple said stitches two by two and to position each pair of stitches on the needles belonging to the first or second semicircle.

The transferring apparatuses are known per se. Specifically, the transferring apparatus 12 can comprise a supporting element 14 preferably having an annular shape and carrying a plurality of transferring members 15, equal in number to the machine needles, to collect all the stitches present on the machine needles. The transferring members may be arranged in the same direction as the needles, each above a respective needle as shown in the figures, so that the free end 16 of each of them can come into contact with the upper part of a respective machine needle and collect the stitch present thereon. Alternatively, the transferring members can be arranged perpendicular to the needles and moved radially with respect to the cylinder to be able to collect the stitch from a respective needle.

Prior to or following the transfer of the stitches of the last course to respective transferring members, the turner 10 overturns the tubular manufactured article so as to turn it inside out, before coupling the opposite stitches to each other and arranging the pairs of stitches on half of the cylinder needles. Subsequently, the turner repositions the tubular manufactured article inside the lower cylinder to close the end.

Preferably, before turning the tubular manufactured article inside out, the turner is shifted from a raised or idle position, in which it is moved away from the positioning device, to a lowered or active position, in which a lower portion thereof is at the positioning device, as shown in FIGS. 3-11.

The transferring apparatus can comprise a sleeve 12' combined with an upper portion thereof, to ensure the correct coupling with the turner, when arranged in the lowered position.

After having turned inside out and repositioned the tubular manufactured article in the cylinder, the turner is advantageously returned from the lowered position to the raised position.

Therefore, the transferring apparatus is configured to collect the stitches of the last course and position them on one half of adjacent needles of the machine needles, while the turner is structured to extract the tubular manufactured article from the cylinder of the machine and to turn the same tubular manufactured article inside out, while remaining above the cylinder, and then to reposition it in the cylinder.

Figure 9:
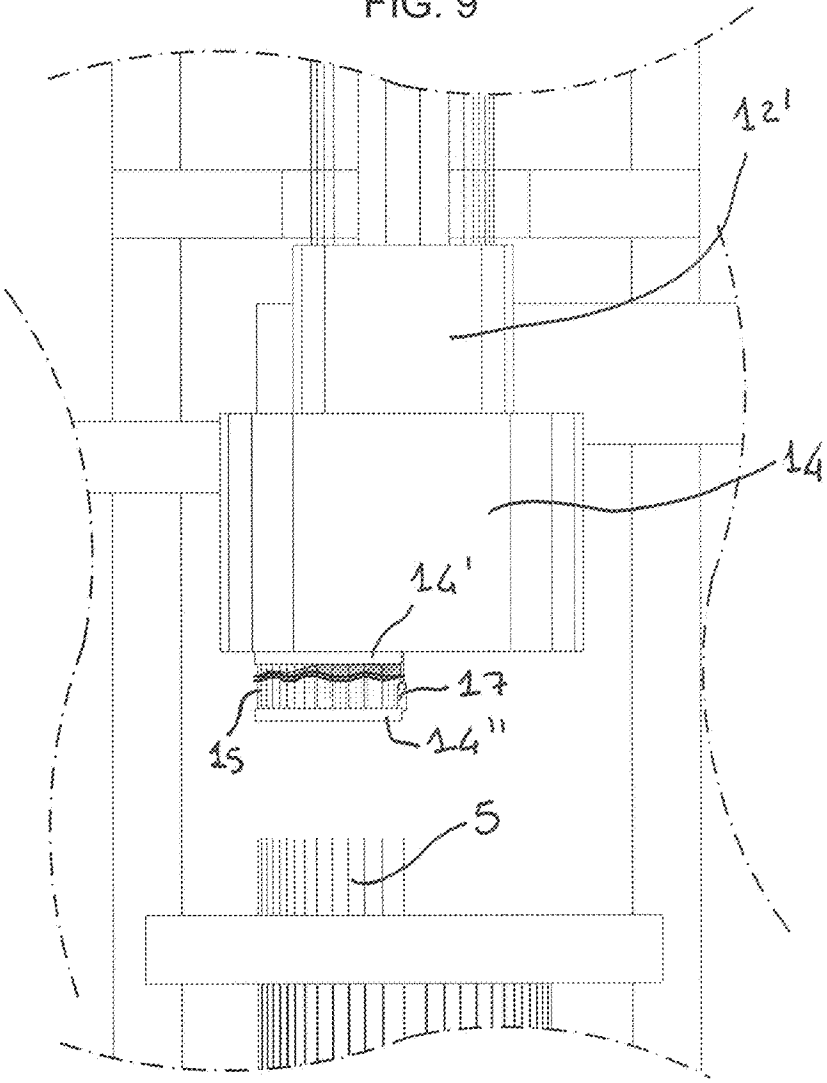
Figure 8:
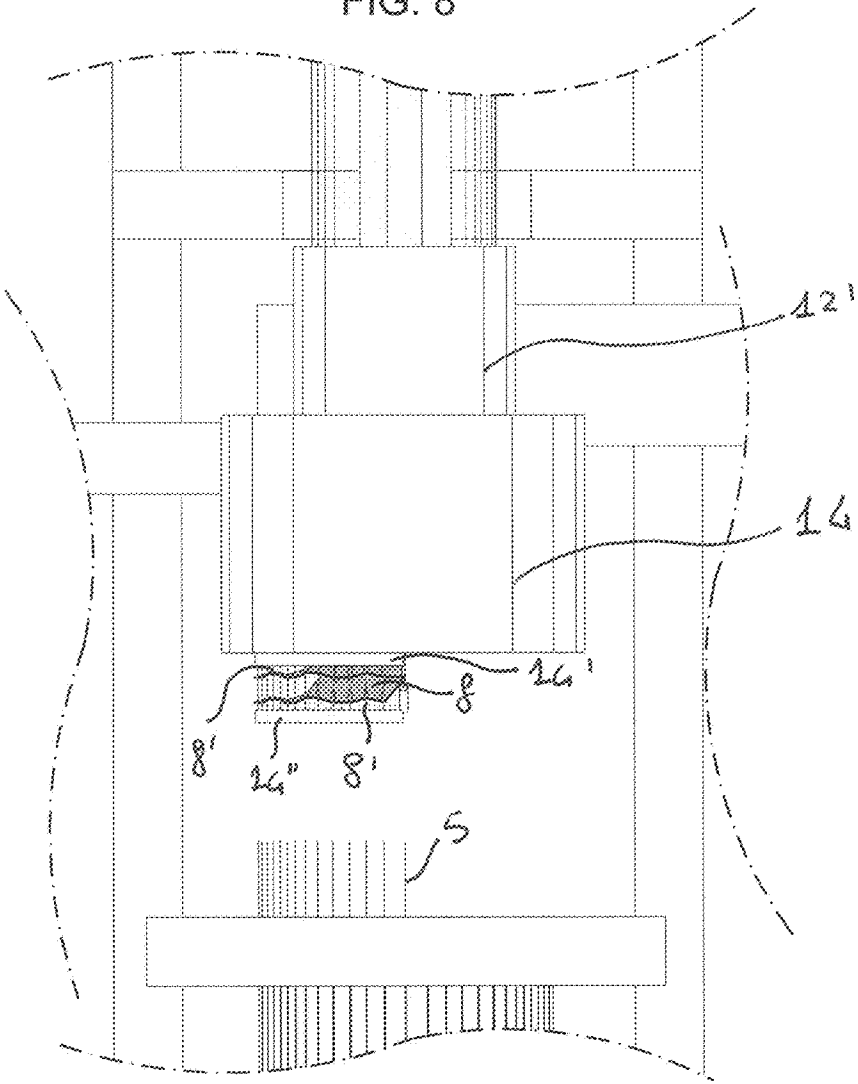
Figure 11:
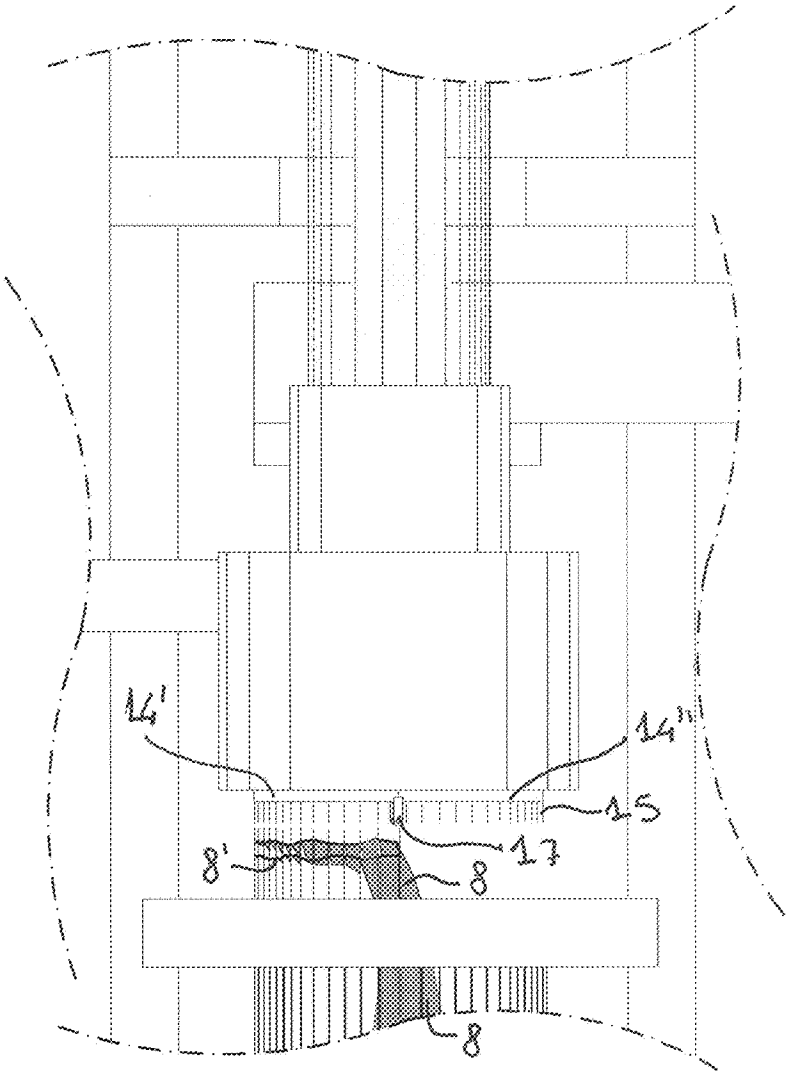
FIGS. 10 and 11 show the steps necessary to transfer pairs of stitches onto one half of the cylinder needles.
Figure 10:
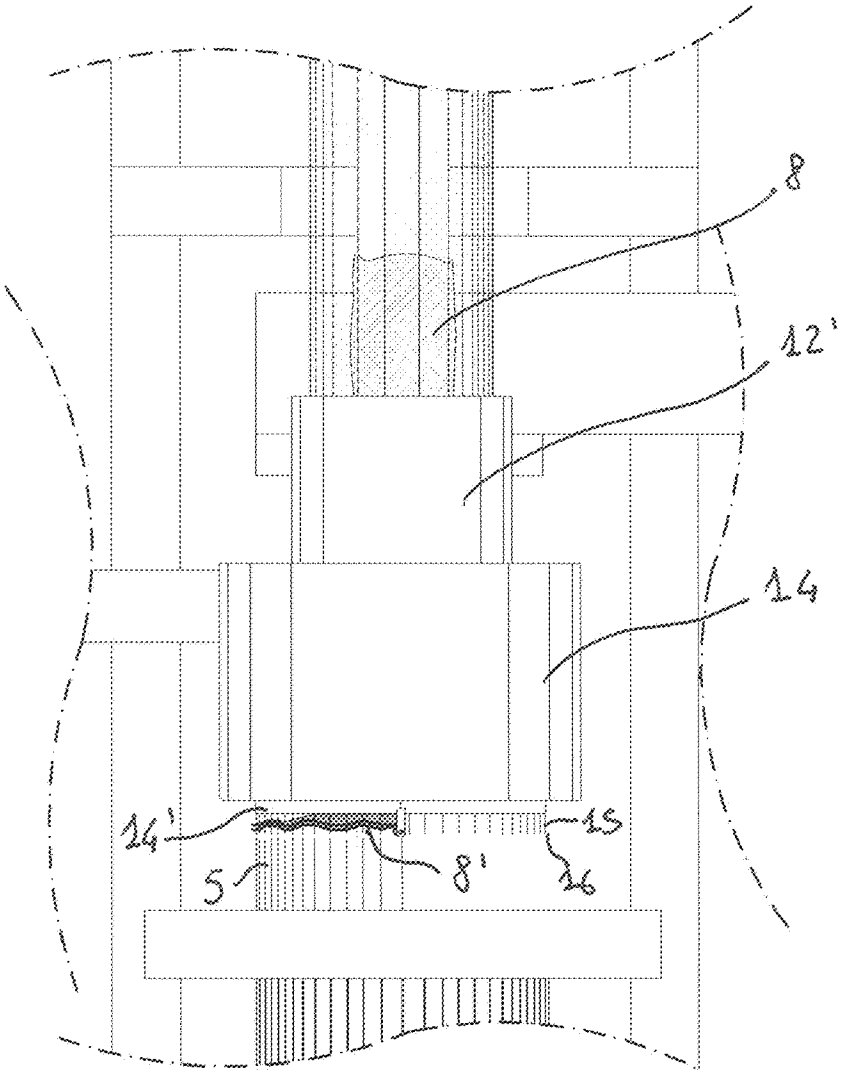

In a preferred solution, the supporting element 14 of the transferring apparatus comprises a fixed portion 14' and a movable portion 14", each carrying the same number of transferring members. The fixed portion and the movable portion are combined with each other by means of a joint 17 which allows to move said movable portion between an initial position, in which it is aligned and coplanar with the fixed portion, as shown e.g. in FIGS. 1-7, and a position rotated by 180° with respect to the initial position, so that each transferring member 15 of said movable portion is close to or in contact with a respective transferring member of the fixed portion, as shown in FIGS. 8 and 9. The transferring apparatus also comprises means for shifting the stitches from the cylinder needles to the transferring members, possibly from the transferring members of the movable portion to those of the fixed portion and from the transferring members of the fixed portion to the cylinder needles. The means for shifting the stitches may comprise hooks and/or pusher elements—not shown—housed in the transferring apparatus.

Preferably, the tubular manufactured article is turned inside out by the turner before transferring the stitches of the last course onto the transferring members of the positioning apparatus.

The turner 10 comprises a containing body 18, or fixed tube, in which a tubular element 19 is slidably mounted. A mouth 20 may be combined with the containing body and suction means—not shown—may be combined therewith. Suction means, not shown, may also be combined with the tubular element.

Advantageously, a lower portion of the containing body is inserted into the sleeve 12' when the turner is arranged in the lowered position. This allows centring the containing body with respect to the positioning apparatus and defines a sealing connection, to ensure a correct suction. In a first turning step, the stitches of the last course are pushed upwards by the upward shift of a tube 21, which is defined as the cylinder tube, normally arranged inside the cylinder 4 of the machine to house the tubular manufactured article during its formation. This way, each stitch of the last course is pushed below the latch 5" of the respective needle. In order to facilitate this operation, the tube 21 can comprise a flared portion 21' at its upper end.

Subsequently, with the turner arranged at the transferring apparatus, the tubular element is shifted downwards so that a portion thereof is inside the tubular manufactured article.

Figure 3:
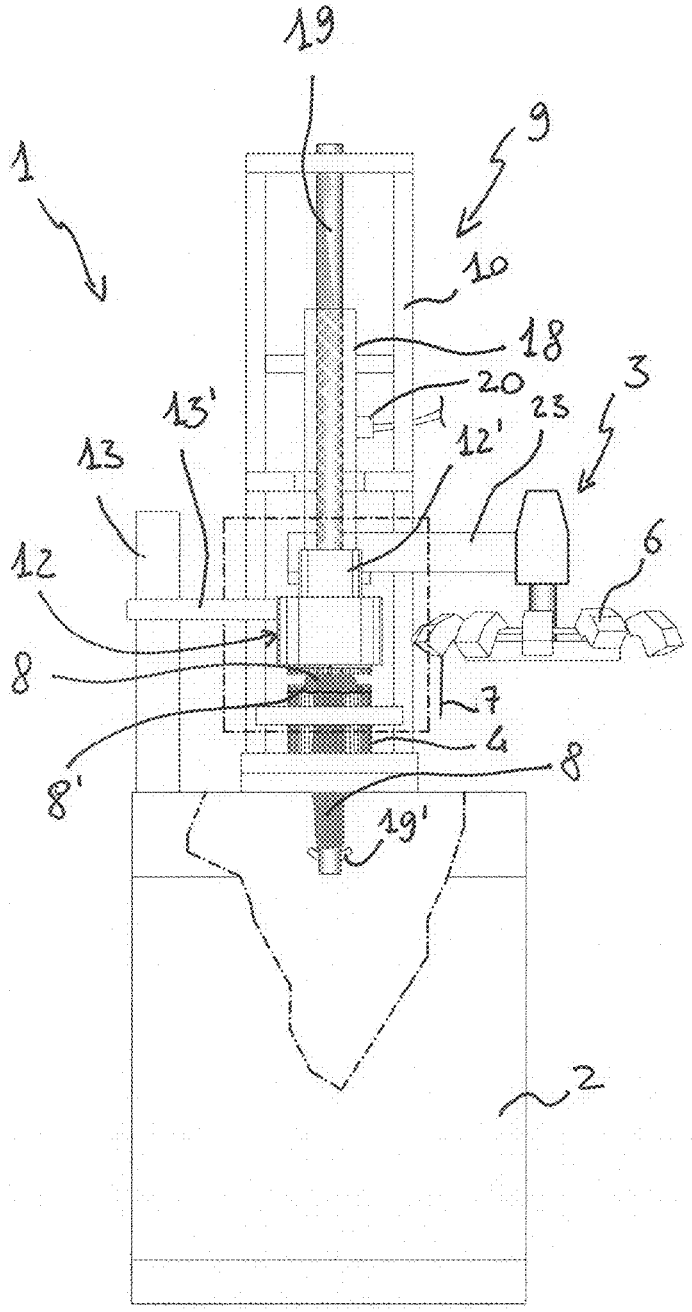
FIG. 3 shows the machine of FIG. 2 with a partial cutaway portion, with the turner in a working position.
Figure 5:
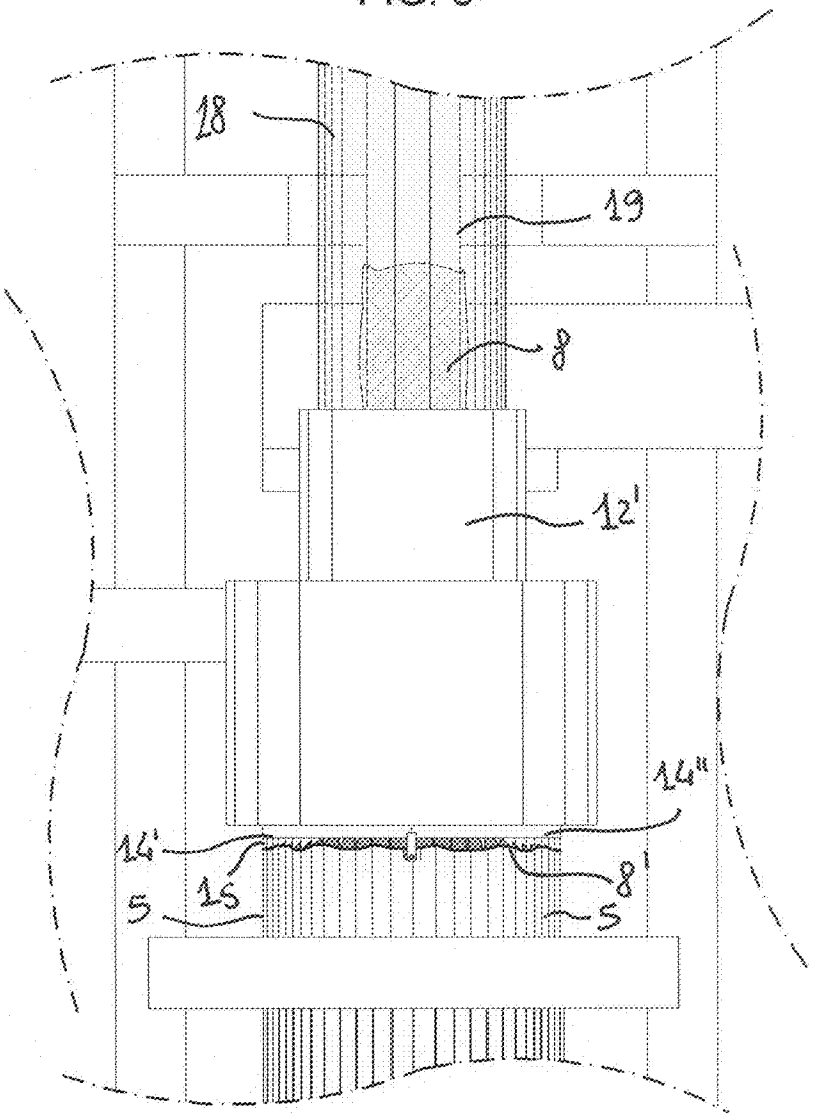
FIGS. 4, 5 and 6 show an enlarged view of the portion of the machine in the box of FIG. 3, with the turner and the transferring apparatus in different steps of turning the tubular manufactured article inside out and collecting the stitches of one end of the same manufactured article.
Figure 4:
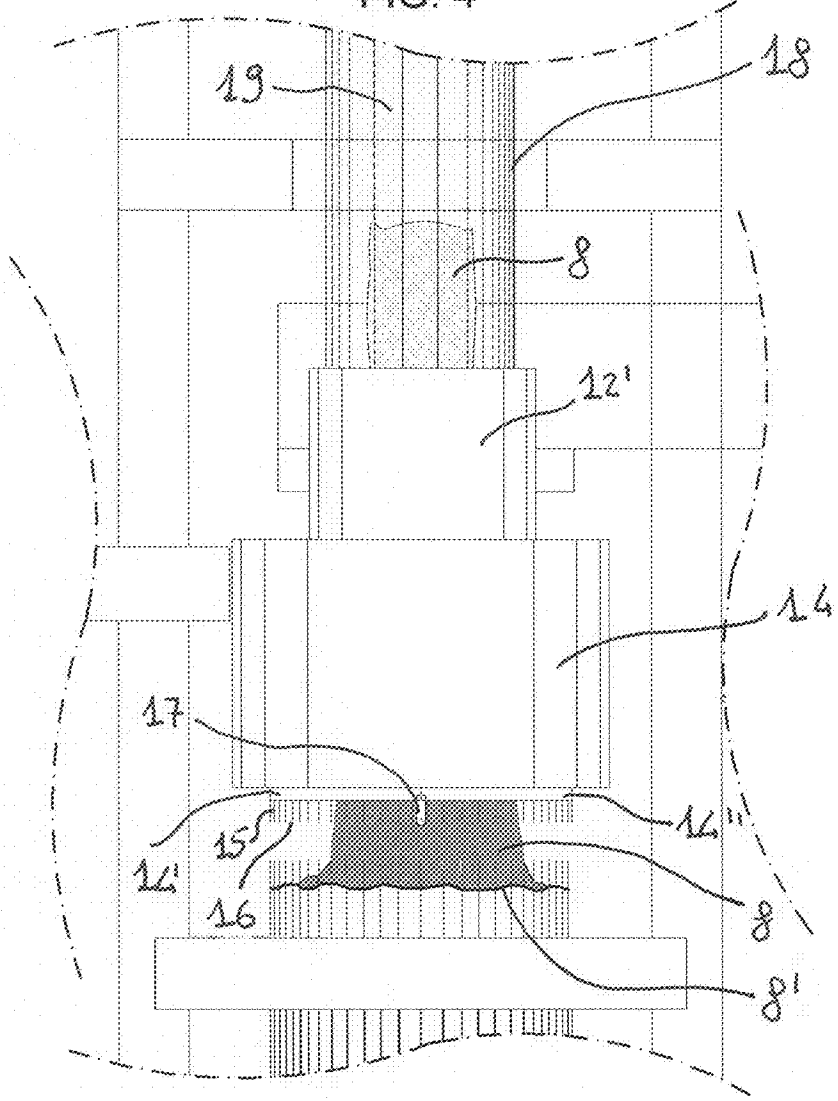
Figure 7:
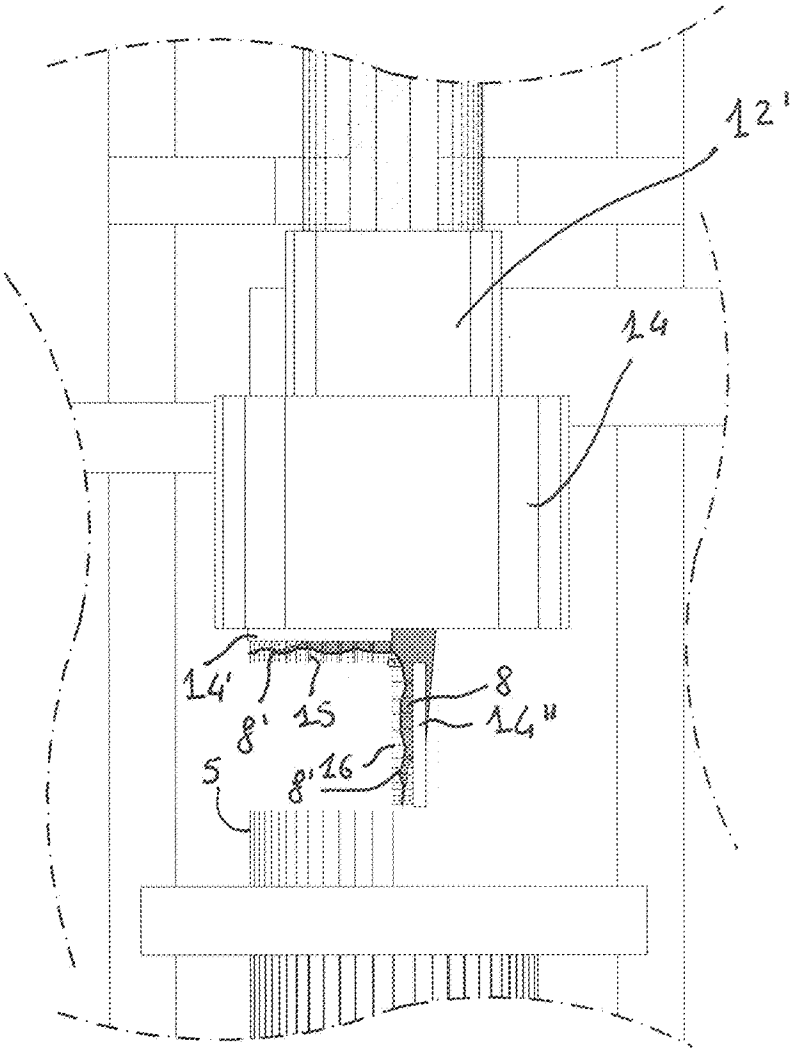
FIGS. 7, 8 and 9 show three subsequent steps necessary to couple the previously collected stitches together.
Figure 6:
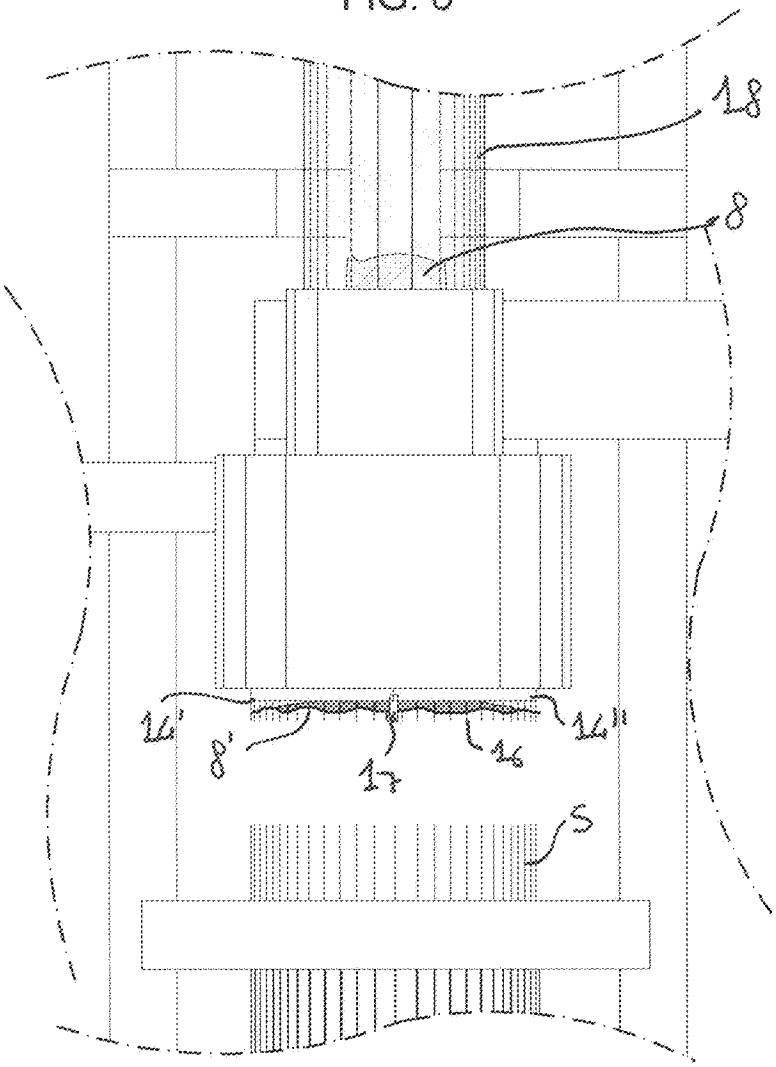

In a particularly preferred solution the tubular element, in the proximity of one lower end thereof, can be provided with at least one pair of harpoons 19' which can be combined with the tubular element in an extractable manner, so that they can be moved between an idle position, in which they are inside the tubular element, and an active position, in which they come out of the tubular element, as shown in FIG. 3. These harpoons can be used as an alternative or in addition to suction means combined with the tubular element, to hold the manufactured article on the tubular element when turning it inside out. It has been observed, in fact, that particularly in case of long manufactured articles, the suction may not be sufficient to keep it correctly combined with the tubular element in its ascending step. The tubular element is therefore configured and moved to be inserted into the tubular manufactured article, so that its lower end comes out thereof. The harpoons, once brought to the active position, prevent the lower end of the tubular manufactured article, normally the edge if the tubular manufactured article is a sock, from slipping out of the tubular element.

To limit the height of the turner, the tubular element can be telescopic.

Once turned inside out, the tubular manufactured article is in the containing body 18 or fixed tube and can be kept in the correct position by the suction means combined with the mouth 20.

Advantageously, the fact of having a turner combined with the machine, so as to be arranged above the cylinder and axially aligned thereto, allows to carry out all the operations necessary to bring the tubular manufactured article to the condition suitable to close one of its ends directly at the machine cylinder. In addition, unlike some solutions of the known art, the presence of means for turning the tubular manufactured article inside out allows to produce it in its normal configuration and to keep it in the cylinder of the machine, and to be able to turn it inside out at the end of its production, with the additional advantage of not having to shift it sideways with respect to the cylinder. In addition, since the turner has a considerable extent in the vertical direction, it is particularly advantageous that it is always arranged above the cylinder, thus avoiding having to move it sideways. Even more advantageously, in order to be able to keep it always above the cylinder, the turner can be provided with means for its vertical movement, so as to keep it above the head of the machine during the production of the tubular manufactured article and to move it closer to the cylinder during the steps of turning the tubular manufactured article inside out and transferring the stitches 8'.

Figure 2:
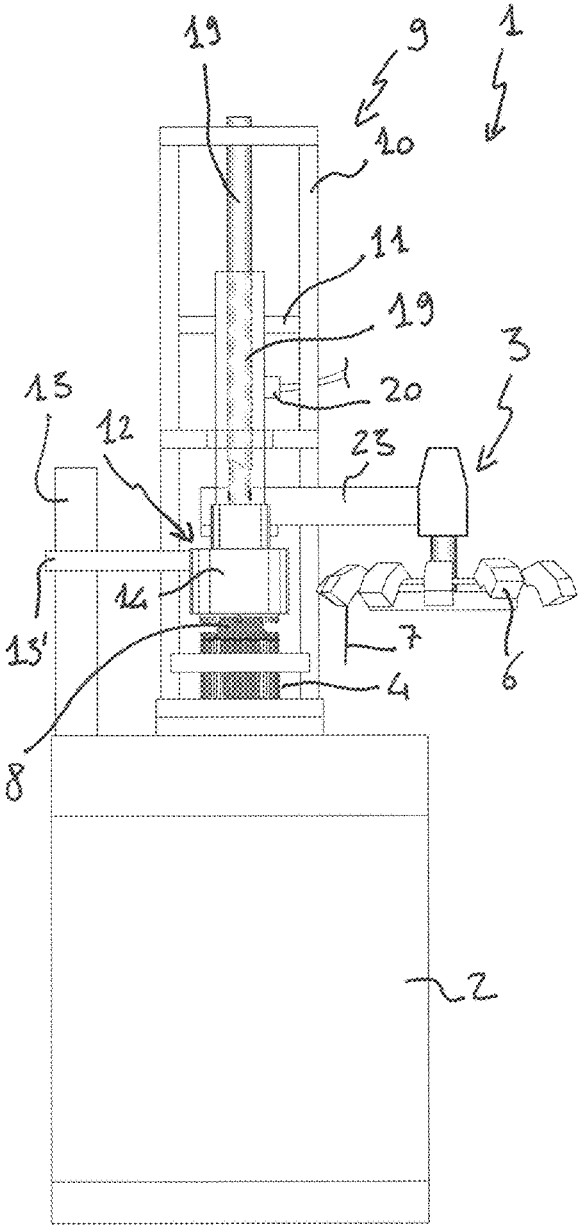
FIG. 2 shows the machine of FIG. 1 in a second condition of use.

In order to allow the operations necessary for overturning the tubular manufactured article by the turner and to be able to arrange the positioning apparatus at the cylinder of the machine, the head 3 of the machine and the feeding stations 6 are combined with the same machine 1 so as to be able to be shifted between an active position, in which they are in the proximity of the cylinder and contribute to the formation of the tubular manufactured article, as shown in FIGS. 1 and 12, and an idle position, in which they are moved away from the cylinder, to completely free the space above it, as shown in FIGS. 2 and 3.

For this purpose, the head 3 and the feeding stations 6 are carried by movement means, preferably of the motorised type, comprising a fixed element 22 and a supporting element 23 which is susceptible of movements with respect to the fixed element. Specifically, the supporting element can be rotated upwards or sideways with respect to the active position by an angle suitable for freeing a space above the cylinder sufficient to receive the transferring apparatus and to allow the turner to move to the lowered position, without them interfering with the head and with the feeding stations of the yarn. Preferably, the angle is at least 45° but more preferably it is about 90°, to leave the space above the cylinder completely free.

Once the transfer of the pairs of stitches on one half of the cylinder needles, the turning of the tubular manufactured article inside out and its subsequent positioning in the cylinder have been completed, the transferring apparatus is returned to the resting position, the turner is brought to the raised position and the movement means return the head and the yarn feeding stations from the idle position to the active position, so that they can contribute to close the end of the tubular manufactured article.

In a particularly preferred solution, the head with the yarn feeding stations are rotated sideways with respect to the active position by an angle of at least 45°, preferably it is about 90°. To ensure the correct centring of the transferring apparatus with respect to the cylinder and the synchronization of the various movements, the transferring apparatus can be connected to the head by means of mechanical idler means 24, so that the shift of the head in a first direction, to move it away from the cylinder, corresponds to a shift of the transferring apparatus, so that it is at the cylinder of the machine and that, vice versa, the shift of the head in a second direction opposite the first one, in order to bring the head at the cylinder, corresponds to a shift of the transferring apparatus, so as to move it away from the cylinder. Preferably, the mechanical idler means 24 are pivoted, on one side, to the arm 13' carrying the transferring apparatus and, on the other side, to the supporting element 23 of the head and of the yarn feeding stations.

After positioning on one half of the cylinder needles pairs of stitches of the last course of the tubular manufactured article, after repositioning the tubular manufactured article in the cylinder 4 and after returning the head and the yarn feeding stations to their active position, at least one yarn 7 is fed again to such needles so as to join the stitches, by knitting them directly to each other by means of this yarn fed to said needles. In order to carry out this operation, the cylinder is rotated with reciprocating motion, in order to carry out at least three, preferably at least five and specifically seven semi-rotations in opposite directions and the needles are brought to different positions to make the stitches necessary to knit the stitches 8" of the two halves of the last course 8' to each other. This allows to join the two half-courses of the end of the tubular manufactured article and, in particular, of a sock, directly in the machine and by using the same cylinder needles used to produce the manufactured article.

In a preferred solution, during the step of transferring the stitches onto half of the cylinder needles, said needles are kept in the raised position A. This allows to reduce the time for performing the seam and to improve the same seam, in particular when carried out with a single yarn.

Preferably, during the at least three semi-rotations, the at least one yarn 7 is fed to the needles brought to the raised position A.

The yarn feeding stations are each provided with one or more yarn fingers to bring the yarn to a position in which it can be intercepted by the needle when brought to the raised position A.

Advantageously, the at least one yarn 7 is fed to the machine by means of a yarn finger referred to as the yarn finger of the bottom yarn 25, since it feeds the yarn in a lowered position with respect, for example, to the yarn finger which normally feeds the so-called main yarn or the so-called colour yarn. This way, in order to intercept the yarn 7, the needle is brought to a first height h, with respect to a plane P, lower than the heights h' and h" which it must reach to intercept the main yarn and the colour yarn, respectively.

Figure 17:
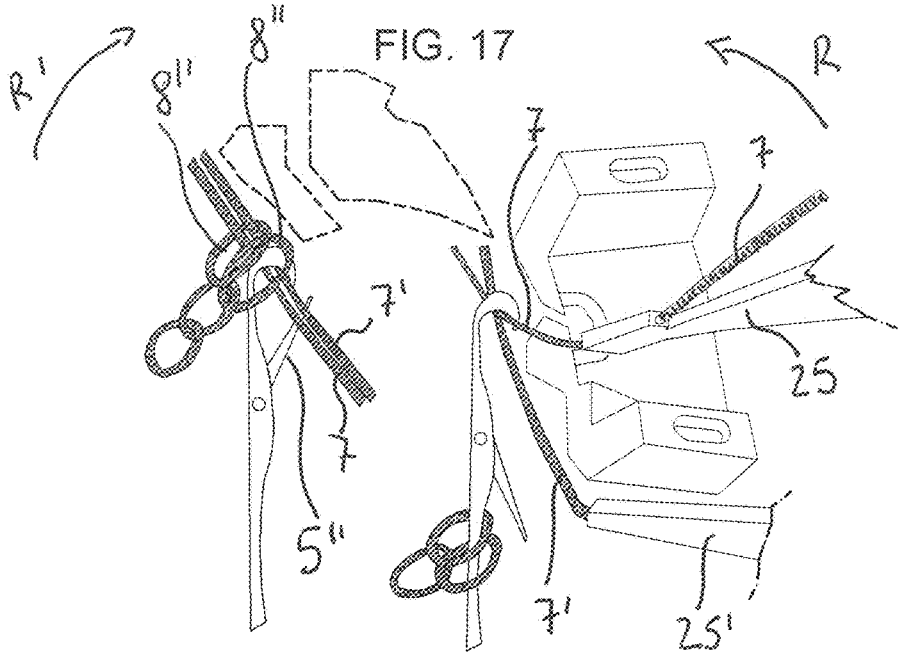
FIG. 17 shows two needles of the machine during a processing step for closing the end of the manufactured article.
Figure 16:
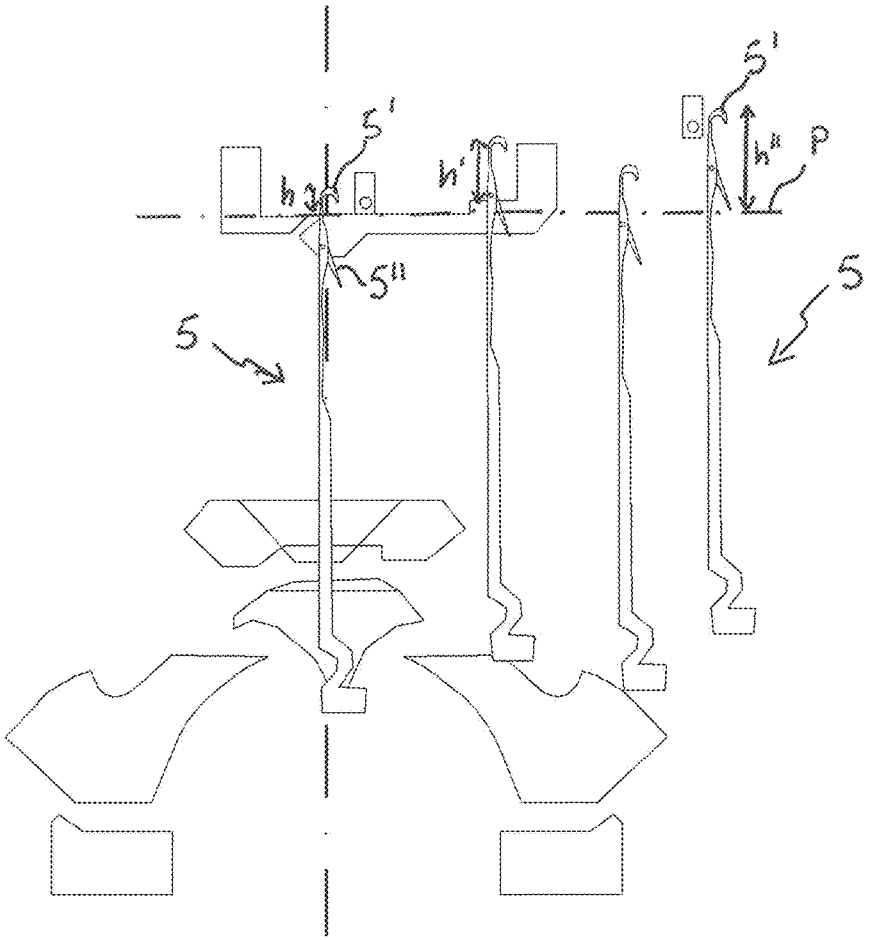
FIG. 16 shows the different heights the machine needles can assume when they are in a raised position, in which they intercept at least one yarn.

Preferably, at least for the first semi-rotation, at least one additional yarn 7' is fed to the needles by means of at least one auxiliary yarn finger 25', which could be a yarn finger normally used to feed the colour yarn, arranged in a position prior to the yarn feeding station comprising the yarn finger of the bottom yarn 25, with reference to the rotation direction R of the cylinder. Since the cylinder rotates with reciprocating motion, it is also susceptible of rotations in a second rotation direction R' opposite the rotation direction R, as shown by the arrows of FIG. 17. Therefore, an auxiliary yarn finger—not shown—could be arranged in a position prior to the yarn feeding station comprising the yarn finger of the bottom yarn 25, with reference to the rotation direction R' of the cylinder.

A further yarn can be fed to the machine needles as an alternative or in addition to the at least one additional yarn. Specifically, this yarn can be an elastic yarn fed by means of a so-called elastic yarn finger belonging to the elastic selecting assembly—not shown—normally present in circular machines for knitwear or hosiery. This way, a further knitted reinforcing yarn is added to the main yarn, thus making the seam even more robust and, therefore, particularly suitable for sports or work socks which are subjected to high stresses during their use.

Advantageously, during at least one semi-rotation of the cylinder, at least two, preferably at least four needles adjacent and prior to the half of the cylinder needles, which carry the pairs of stitches of the last course of the tubular manufactured article, and/or at least two, preferably at least four needles adjacent to and following half of the cylinder needles, which carry the pairs of stitches of the last course of the tubular manufactured article, are brought to the raised position. This allows to form two small stitch segments at the ends of the seam which prevent the yarn from slipping out when the closed end of the tubular manufactured article is subjected to stresses in different directions.

Preferably, the seam is made by means of at least three, preferably at least five semi-rotations in opposite directions, in particular seven semi-rotations, depending on the type of manufactured article and the type of yarn by which it is made.

Advantageously, semi-rotations in which tightly-knitted stitches are made, are alternated with semi-rotations in which loosely-knitted stitches are made.

The method according to the invention therefore provides for closing the end of a tubular manufactured article and, in particular, the toe of a sock, directly on the circular machine, without the aid of any linking or sewing device to be combined with the machine. This closure can be achieved by turning the tubular manufactured article inside out, positioning, on one half of the cylinder needles, pairs of stitches of the last course, each comprising a stitch initially carried by a needle belonging to one half of the cylinder needles and a stitch initially carried by a needle opposite the other half of the cylinder needles, with reference to a diameter D of the cylinder, and joining such stitches by processing at least one yarn with the cylinder needles carrying such pairs of stitches. Therefore and advantageously, the end of the manufactured article and, specifically, the toe if it is a sock, is closed or joined by means of a part of the cylinder needles, which have contributed to the formation of the remaining part of the manufactured article, with the manufactured article turned inside out, in order to achieve a seam that remains therein and after having made the manufactured article in a traditional manner, by keeping it positioned and sucked in the lower cylinder 4 of the machine during its formation, as usual.

Preferably, the stitches of the needles of the first semicircle SC1 are positioned on the needles of the second semicircle SC2 but this does not exclude that pairs of stitches originally supported by opposite cylinder needles are combined with each other and then rotated by a desired angle before each is arranged on a needle of one half of adjacent cylinder needles.

In order to achieve the joining of the end of the article, the cylinder is rotated to carry out at least three, preferably at least five rotations, preferably with reciprocating motion to carry out at least three semi-rotations in opposite directions, advantageously from five to seven semi-rotations in which, at the yarn feeding station, the needles are brought to the raised position to knit at least one yarn with each pair of stitches being carried by each needle of one half of the cylinder needles.

At the end of the step of joining the stitches of its end, the manufactured article is unloaded from the machine with one end thereof already closed. Therefore, this method allows the manufactured article to be made in the traditional way, starting from an end thereof, i.e. the edge in the case of a sock, which is intended to remain open, and ending with the opposite end which is closed directly by the machine needles, at the end of the production of the manufactured article.

In order to allow the transferring apparatus to be arranged above the cylinder and the turner to move closer to the transferring apparatus during the turning, collecting and positioning steps, the head and the yarn feeding stations are moved to an idle position, either by overturning or lateral shift.

After the turning the tubular manufactured article inside out and extracting it from the cylinder, half of the stitches of the last course are collected by the transferring members of the movable portion and the other half is possibly collected by the transferring members of the fixed portion. In this case, the stitches are coupled to each other, by overturning the movable portion onto the fixed portion and pushing or pulling the stitches present on the movable portion so that they pass on the fixed portion. In an alternative solution, the turning of the tubular manufactured article inside out can take place after the stitches are collected from the cylinder needles.

Finally, the stitches thus coupled are shifted from the fixed portion, after moving the movable portion away, halfway through the cylinder needles, by suitable means. In the event that only one half of the stitches are collected, at the end of the collection, the movable portion is overturned directly on the needles of the second half of the cylinder and the stitches supported by it are carried onto such needles. Subsequently, the tubular manufactured article is positioned inside the cylinder.

At this point, the head and the yarn feeding stations are returned to the active position to contribute to close the end of the manufactured article, by processing the yarn by means of the half of the cylinder needles on which the stitches are arranged.

The invention is therefore based on this concept: turning the tubular manufactured article inside out, collecting at least half of the stitches of the last course of the tubular manufactured article, which are arranged on adjacent cylinder needles, shifting the collected stitches so that pairs of stitches originally arranged on opposite cylinder needles are on one half of the cylinder needles, and joining the stitches by processing a yarn fed at least to the needles of said other half of the needles, so that the end of the tubular manufactured article is closed directly by the same needles that have contributed to the formation of the manufactured article. Therefore, in order to meet contingent and specific needs, a person skilled in the art can make numerous changes and modifications to the present invention or embodiments depicted and described, all thereby comprised in the protection scope of the invention, as defined in the following claims.

The invention claimed is:

1. A circular machine for producing tubular manufactured articles comprising a plurality of consecutive courses, each in turn comprising a plurality of stitches, wherein the circular machine comprises:

a head, at least one cylinder housing a plurality of needles that are vertically arranged within the at least one cylinder, the plurality of needles are further arranged side by side to form a first semicircle and a second semicircle, one or more feeding stations that are configured to feed at least one yarn to the needles, wherein the needles are moveable in upward and downward movements to form the plurality of stitches of the at least one yarn, the tubular manufactured article during production being kept inside the at least one cylinder, a turner arranged above and axially aligned with the at least one cylinder, the turner being configured to extract the tubular manufactured article from the at least one cylinder and turn the tubular manufactured article inside out while bringing and keeping the tubular manufactured article above the at least one cylinder, and a transferring apparatus configured for;

collecting, from at least one first half of consecutive needles of the needles, the respective stitches of at least one half of a last course of the plurality of consecutive courses of the tubular manufactured article, and, arranging, with the tubular manufactured article turned inside out, on each of the needles of a half of the needles two stitches that are joined by processing at least one yarn through at least the half of the needles, the turner being configured to reposition the tubular manufactured article within the cylinder, after pairs of stitches of the last course of the tubular manufactured article have been positioned on half of the needles.

2. The circular machine according to claim 1, wherein:

the turner comprises a containing body and a tubular element slidingly mounted in the containing body, a lower end portion of the containing body is joinable to a sleeve combined with the transferring apparatus, the containing body and the tubular element have suction means combined therewith, and the turner is movable between a raised position, in which the turner is above the head, and a lowered position, in which the turner is at the transferring apparatus, and vice versa.

3. The circular machine according to claim 2, wherein the tubular element comprises, at a lower end thereof, at least two harpoons emerging from opposite sides.

4. The circular machine according to claim 1, wherein the cylinder has a tube for housing the tubular manufactured article during formation, and wherein the tube is moveable upward to push each stitch of the last course below the latch of the respective needle, the tube comprising at an upper end thereof a flared portion.

5. The circular machine according to claim 1, wherein the transferring apparatus is movable between a resting position, in which the transferring apparatus is shifted sideways with respect to the at least one cylinder, and a working position in which the transferring apparatus is located at the cylinder and vertically aligned therewith, and wherein the head and the at least one yarn feeding station are combined with the circular machine by means of movement means in order to be moved between:

an active position, in which they are at the cylinder, in order to contribute to the formation of the tubular manufactured article and to contribute to close an end of the tubular manufactured article, and an idle position, in which they are away from the at least one cylinder, in order to allow the positioning device to be brought into the working position, the head and at least one yarn feeding station being combinable with the transferring apparatus by a mechanical idler, for a synchronous movement.

6. The circular machine according to claim 1, wherein the transferring apparatus comprises:

a number of transferring members equal to the number of the needles, to collect from each needle the stitches of the last course, couple the stitches two by two and position each pair of stitches on a half of the needles, and a supporting element having at least one fixed portion carrying a plurality of transferring members whose number is equal to half of the needles and a movable portion carrying the same number of transferring members as the fixed portion, wherein the movable portion is moveable between an initial position, in which the moveable portion is aligned and coplanar with the fixed portion, and a position rotated by 180° with respect to the initial position, in which each of the transferring members is adjacent or in contact with either a respective transferring member of the fixed portion, and wherein the transferring members are arranged in the same direction as the needles, each above a respective needle, so that their free end can contact the upper part of a respective machine needle and collect the stitch thereon, or wherein the transferring members are arranged perpendicularly to the needles and are moved radially with respect to the cylinder, in order to collect the stitch from a respective needle.

7. A method for closing an end of a tubular manufactured article comprising a plurality of consecutive courses, each in turn comprising a plurality of stitches, the method comprising:

providing a circular machine comprising:

at least one cylinder, a plurality of needles that are vertically arranged within the at least one cylinder, which plurality of needles are further arranged side by side to form a first semicircle and a second semicircle, a head, and one or more feeding stations that are configured to feed at least one yarn to the needles, wherein the needles are moveable in upward and downward movements to form the plurality of stitches of the at least one yarn, the tubular manufactured article during production being kept inside the at least one cylinder, wherein after the steps of producing the tubular manufactured article up to a last course of the plurality of consecutive courses, the method further comprises the steps of:

a) extracting, by a turner arranged above and axially aligned with the at least one cylinder, the tubular manufactured article from the cylinder and turning the tubular manufacture article inside out so that the tubular manufactured articles outer part is on the inside and vice versa;

b) collecting, by a transferring apparatus, from each needle of at least one half of consecutive needles of the needles the respective stitch of the last course;

c) arranging the stitches of a half of the last course that were collected at step b) on corresponding needles of a second half of the needles, so that the needles of the second half of the needles carry pairs of stitches of the last course, which were arranged, at first, on opposite needles with reference to a diameter of the cylinder;

d) positioning the tubular manufactured article inside the cylinder;

e) feeding the at least one yarn to the needles;

f) joining together the pairs of stitches to close the end of the tubular manufactured article, by processing the at least one yarn with the needles of the second half of the needles, wherein the steps a) and b) are reversible, and wherein the step f) involves the knitting of the stitches together, by processing the at least one yarn by part of the same needles that contributed to the formation of the tubular manufactured article, without using any specific needle or any linking or sewing device outside the circular machine, or otherwise combined therewith.

8. The method according to claim 7, wherein the turner comprises a tubular element provided, at a lower end thereof, with at least two harpoons emerging from opposite sides, the harpoons being connected with the tubular element in an extractable manner, and wherein the step a) provides for:

inserting the tubular element inside the tubular manufactured article so that the lower end thereof sticks out of the tubular manufactured article, extracting the harpoons to hold the free end of the tubular manufactured article, and moving upward the tubular element so that the tubular manufactured article is dragged therewith and turned inside out.

9. The method according to claim 7, wherein the cylinder has a tube combined therewith for housing the tubular manufactured article during formation, and wherein before step a), the tube is moved upward to push each stitch of the last course below the latch of the respective needle, wherein the tube comprises a flared portion at an upper end thereof.

10. The method according to claim 7, wherein in step f) the rotating cylinder is rotated in reciprocating motion along at least three semi-rotations, and wherein in the semi-rotations, the needles are brought to a raised position in which they intercept the yarn and in which they bring the pairs of stitches they support to a position to be unloaded from the respective needle.

11. The method according to claim 7, wherein the at least one yarn is fed to the needles by a yarn finger of the bottom yarn, which is adapted to feed the yarn to the needles at a first height lower than a height the needles must reach in order to take the yarn fed by the other yarn fingers, and wherein at least one additional yarn is fed to the needles by at least one auxiliary yarn finger arranged in a position preceding the yarn feeding station comprising the yarn finger of the bottom yarn, with reference to a rotation direction of the cylinder.

12. The method according to claim 7, wherein at least one further yarn is fed to the needles, the further yarn being an elastic yarn that is fed to the needles by a yarn finger of the elastic yarn.

13. The method according to claim 7, wherein during at least the first semi-rotation at least two additional needles adjacent a first needle of the second half of the needles which carry the pairs of stitches of the last course or at least two additional needles adjacent the last needle of the second half of the needles which carry the pairs of stitches of the course, are brought to the raised position in which they intercept the yarn.

14. The method according to claim 7, wherein one or more semi-rotations, in which tightly-knitted stitches are made, alternate with one or more semi-rotations in which loosely-knitted stitches are made.

15. The method according to claim 7, wherein before step a) it is provided to:

move the head and the one or more feeding stations away from the cylinder in order to clear a space above the cylinder, adapted to accommodate the transferring apparatus, and combine a lower end portion of the turner with a sleeve combined with the transferring apparatus, by bringing the turner to a lowered position in which the turner is at the transferring apparatus, wherein step b) provides the individual collection from each needle of the respective stitch of the last course of the manufactured article, and wherein step c) provides that the stitches are coupled two by two and each pair of stitches are positioned on a half of the needles.

16. The method according to claim 7, wherein the stitches of the last course are collected by a transferring apparatus which comprises a supporting element having a plurality of transferring members, the transferring apparatus being movable between a resting position, in which the transferring apparatus is shifted sideways with respect to the at least one cylinder, and a working position, in which the transferring apparatus is at the cylinder, wherein the supporting element comprises a fixed portion carrying a plurality of the transferring members, each corresponding to a respective needle of a half of the needles belonging to the first semicircle, and a movable portion carrying a plurality of the transferring members, each corresponding to a respective needle of a half of the needles belonging to the second semicircle, wherein the movable portion is rotatable in order to be moved from an initial position, in which each transferring member is at a respective needle of a half of the needles belonging to the second semicircle, to a position rotated by 180°, in which each transferring member is adjacent to or at a respective transferring member of the fixed portion, and wherein step c) comprises the steps of:

c') moving the stitches present on each transferring member of the movable portion to the corresponding transferring member of the fixed portion, c") returning the movable portion to the initial position, and c'") moving the pairs of stitches from the transferring members of the fixed portion to the second half of the needles.

* * * * *